US011518168B2

(12) United States Patent
Takagi

(10) Patent No.: US 11,518,168 B2
(45) Date of Patent: Dec. 6, 2022

(54) LIQUID DISCHARGE HEAD

(71) Applicant: CANON KABUSHIKI KAISHA, Tokyo (JP)

(72) Inventor: Makoto Takagi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 17/145,854

(22) Filed: Jan. 11, 2021

(65) Prior Publication Data

US 2021/0221130 A1 Jul. 22, 2021

(30) Foreign Application Priority Data

Jan. 16, 2020 (JP) ..... JP2020-005410

(51) Int. Cl.
*B41J 2/14* (2006.01)

(52) U.S. Cl.
CPC .... *B41J 2/1433* (2013.01); *B41J 2002/14491* (2013.01)

(58) Field of Classification Search
CPC ..... B41J 2/1433
See application file for complete search history.

(56) References Cited

U.S. PATENT DOCUMENTS 6,439,690 B2 * 8/2002 Ishinaga ..... B41J 2/14129 347/58
2009/0025634 A1 * 1/2009 Chung ..... B41J 2/14129 118/59
2011/0134192 A1 * 6/2011 Furukawa ..... B41J 2/14129 347/58
2013/0063527 A1 * 3/2013 Ge ..... B41J 2/14056 347/86

FOREIGN PATENT DOCUMENTS

JP 2017-213708 A 12/2017

* cited by examiner

*Primary Examiner* — Jason S Uhlenhake
(74) *Attorney, Agent, or Firm* — Canon U.S.A., Inc. IP Division

(57) ABSTRACT

A liquid discharge head includes a plurality of discharge elements, a plurality of driving elements, a plurality of control circuits, a first ground wiring and a first power supply wiring configured to supply power to the plurality of discharge elements and the plurality of driving elements, and a second ground wiring and a second power supply wiring configured to supply power to the plurality of control circuits. The first ground wiring and the first power supply wiring include, in a first conductive layer of a plurality of conductive layers, a first wiring group extending in a first direction, and in a second conductive layer, a second wiring group extending in a second direction which intersects with the first direction. The second power supply wiring is arranged on one of the first conductive layer and the second conductive layer.

17 Claims, 7 Drawing Sheets

LIQUID DISCHARGE HEAD

BACKGROUND

Field of the Disclosure

The present disclosure relates to a liquid discharge head.

Description of the Related Art

There is known a liquid discharge head that causes a liquid to be discharged from each supply port by applying energy generated by a discharge element to the liquid. A plurality of discharge elements are arranged in a liquid discharge head to implement high-speed printing. A current supplied to the head may change in accordance with the number of discharge elements that are driven simultaneously, and if the voltage to be applied to the discharge elements varies in accordance with this change, the amount of liquid to be discharged will vary and the quality of the image to be formed may degrade. Japanese Patent Laid-Open No. 2017-213708 discloses a wiring structure that can reduce the influence of voltage reduction.

Specifically, when plate-like power supply wiring is used as a ground wiring and power supply wiring, to the discharge elements, two such layers will be needed in addition to the layer to be used by the control circuit for controlling the discharge elements.

SUMMARY

According to an aspect of the disclosure, the present disclosure provides a liquid discharge head comprising a plurality of discharge elements each arranged in a first direction, a plurality of driving elements connected to the plurality of discharge elements and each configured to drive a corresponding one of the plurality of discharge elements, a plurality of control circuits each configured to control a corresponding one of the plurality of driving elements, a first ground wiring and a first power supply wiring configured to supply power to the plurality of discharge elements and the plurality of driving elements, a second ground wiring and a second power supply wiring configured to supply power to the plurality of control circuits, and a plurality of supply ports arranged along the first direction and configured to supply a liquid to the plurality of discharge elements, wherein the first ground wiring and the first power supply wiring include, in a first conductive layer of a plurality of conductive layers which have been stacked, a first wiring group extending in the first direction, and include, in a second conductive layer different from the first conductive layer of the plurality of conductive layers, a second wiring group extending in a second direction which intersects with the first direction, and the second power supply wiring is arranged on one of the first conductive layer and the second conductive layer.

Further features of the present disclosure will become apparent from the following description of exemplary embodiments (with reference to the attached drawings).

DESCRIPTION OF THE EMBODIMENTS

Figure 1:
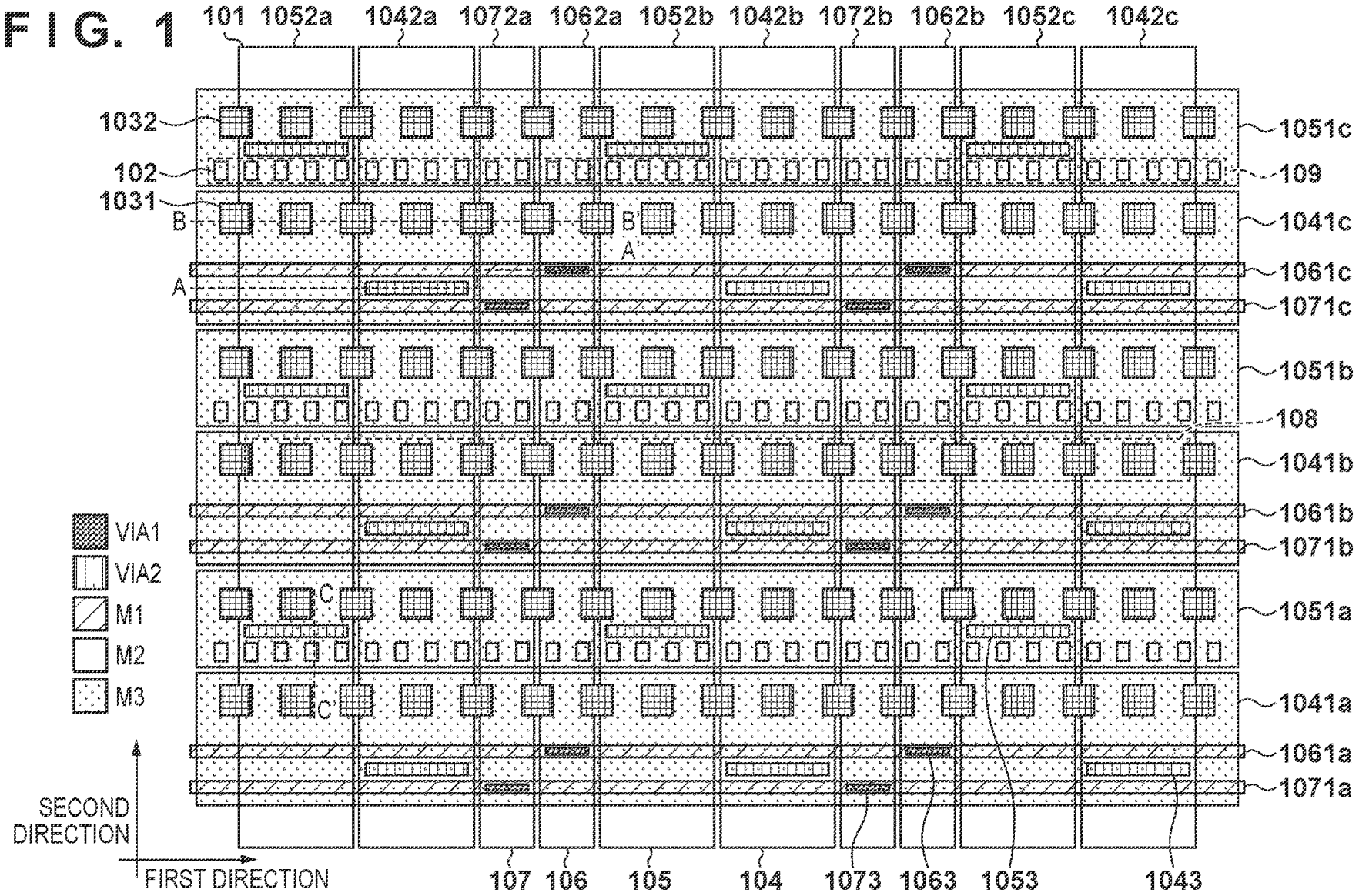
FIG. 1 is a plan view for a liquid discharge head according to the first embodiment.

Hereinafter, embodiments will be described in detail with reference to the attached drawings. Note, the following embodiments are not intended to limit the scope of the claimed disclosure. Multiple features are described in the embodiments, but limitation is not made that requires all such features, and multiple such features may be combined as appropriate. Furthermore, in the attached drawings, the same reference numerals are given to the same or similar configurations, and redundant description thereof is omitted.

First Embodiment

A liquid discharge head according to the first embodiment of the present disclosure will be described with reference to a plan view shown in FIG. 1. A plurality of discharge elements 102 are arranged in a first direction on a substrate 101 to form each discharge element array 109. In the vicinity of each discharge element array 109, supply ports 1031 and 1032 are arranged for supplying a liquid to every two discharge elements 102 and form supply port arrays along the discharge element array. In a similar manner, in the vicinity of each discharge element array, a driving element (not shown) and a control circuit (not shown) for controlling the driving/non-driving of the driving element are formed in a one-to-one correspondence with each discharge element 102. In this embodiment, a plurality of such discharge element arrays are arranged in a second direction which intersects with the first direction. The first direction and the second direction are perpendicular to each other in this embodiment.

Each discharge element includes two electrical terminals; power from a power supply is supplied to one terminal, and the other terminal is connected to ground via the corresponding driving element. The ground side of the discharge element 102 is connected to a first ground wiring 104 via the driving element. The first ground wiring 104 includes a first wiring group 1041 which includes wirings 1041*a* to 1041*c* extending in the first direction and a second wiring group 1042 which includes wirings 1042*a* to 1042*c* extending in a second direction. As will be described later, the wirings 1041*a* to 1041*c* of the first wiring group 1041 and the wirings 1042*a* to 1042*c* of the second wiring group 1042 are arranged on different conductive layers from each other and are connected by vias 1043. In a similar manner, the power supply side of each discharge element 102 is connected to a first power supply wiring 105. The first power supply wiring 105 includes a first wiring group 1051 which includes wiring lines 1051*a* to 1051*c* extending in the first direction and a second wiring group 1052 which includes wirings 1052*a* to 1052*c* extending in the second direction. The wirings 1051*a* to 1051*c* of the first wiring group 1051 and the wirings 1052*a* to 1052*c* of the second wiring group 1052 are arranged on different conductive layers from each other and are connected by vias 1053.

A second power supply wiring 106 for supplying a power supply voltage and a ground-side second ground wiring 107 are connected to each control circuit. The second power supply wiring 106 includes a first wiring group 1061 which includes wirings 1061*a* to 1061*c* extending in the first direction and a second wiring group 1062 which includes second wirings 1062*a* and 1062*b* extending in the second direction. The wirings 1061*a* to 1061*c* of the first wiring group 1061 and the second wirings 1062*a* and 1062*b* of the second wiring group 1062 are connected by vias 1063. Also, the second ground wiring 107 includes a first wiring group 1071 which includes wirings 1071*a* to 1071*c* extending in the first direction and a second wiring group 1072 which includes wirings 1072*a* and 1072*b* extending in the second direction. The wirings 1071*a* to 1071*c* of the first wiring group 1071 and the wirings 1072*a* and 1072*b* of the second wiring group 1072 are connected by vias 1073.

The liquid discharge head according to this embodiment includes a wiring layer formed by stacking three conductive layers. The wiring layer may be formed on a semiconductor substrate with an insulating layer sandwiched in between. A semiconductor circuit formed by the driving elements for turning on/off the current flowing to the discharge elements, the control circuits for controlling the driving elements, and the like is formed on the substrate 101. Assume that the side on which the semiconductor circuit is formed is the lower layer, and the side on which the discharge elements are formed is the upper layer. In this case, the conductive layers will be referred to as, in order from the lower layer, a first conductive layer M1, a second conductive layer M2, and a third conductive layer M3. The first wiring group of the first ground wiring 104 and the first wiring group of the first power supply wiring 105 are arranged on the third conductive layer M3, and the second wiring group of the first ground wiring 104 and the second wiring group of the first power supply wiring 105 are arranged on the second conductive layer M2. In addition, the first wiring group is arranged on the first conductive layer M1 and the second wiring group is arranged on the second conductive layer M2 for each of the second power supply wiring 106 and the second ground wiring 107.

As described above, in this embodiment, the second wiring group 1042 of the first ground wiring 104, the second wiring group 1052 of the first power supply wiring 105, the second wiring group 1062 of the second power supply wiring 106, and the second wiring group 1072 of the second ground wiring 107 are arranged on the second conductive layer M2.

Figure 2A:
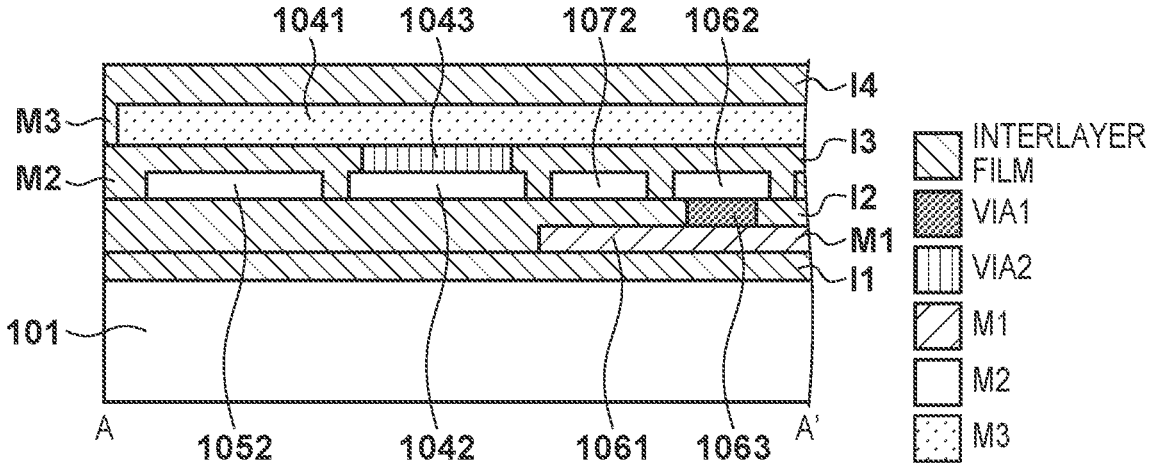
FIGS. 2A to 2C are sectional views of the liquid discharge head.

FIG. 2A is a sectional view of a liquid discharge head according to this embodiment taken along a line A-A' of FIG. 1. The arrangement of the conductive layers according to this embodiment will be described below. Insulating layers 11 to 14 and the conductive layers M1 to M3 are formed on the substrate 101 in the order of Il, M1, 12, M2, 13, M3, and I4. The conductive layers M1 to M3 are patterned as needed and are used as wirings. Regarding the thicknesses of the conductive layers, the third conductive layer M3 may be thicker than the first conductive layer M1 and the second conductive layer M2. In this embodiment, the thickness of the third conductive layer M3 may be twice the thickness of each of the first conductive layer M1 and the second conductive layer M2.

The first wirings 1061*a* to 1061*c* of the second power supply wiring and the first wirings 1071*a* to 1071*c* of the second ground wiring are arranged on the first conductive layer M1. The second wirings 1062*a* and 1062*b* of the second power supply wiring and the second wirings 1072*a* and 1072*b* of the second ground wiring, the second wirings 1052*a* to 1052*c* of the first power supply wiring, and the second wirings 1042*a* to 1042*c* of the first ground wiring are arranged on the second conductive layer M2. Also, the first wirings 1041*a* to 1041*c* of the first ground wiring and the first wirings 1051*a* to 1051*c* of the first power supply wiring are arranged on the third conductive layer M3 as the upper layer. In the following description, the suffixes a to c may be omitted in cases in which specific wiring lines within the wiring need not be particularly discriminated. For example, the first ground wirings 1041*a* to 1041*c* of the M3 layer may be denoted as the first ground wirings 1041.

The second wiring group 1042 and the first wiring group 1041 arranged on the second conductive layer M2 and the third conductive layer M3, respectively, are connected by the vias 1043 formed on the insulating layer 13. Also, the first wiring group 1061 and the second wiring group 1062 arranged on the first conductive layer M1 and the second conductive layer M2, respectively, are connected by the vias 1063 formed on the insulating layer 12.

Figure 2B:
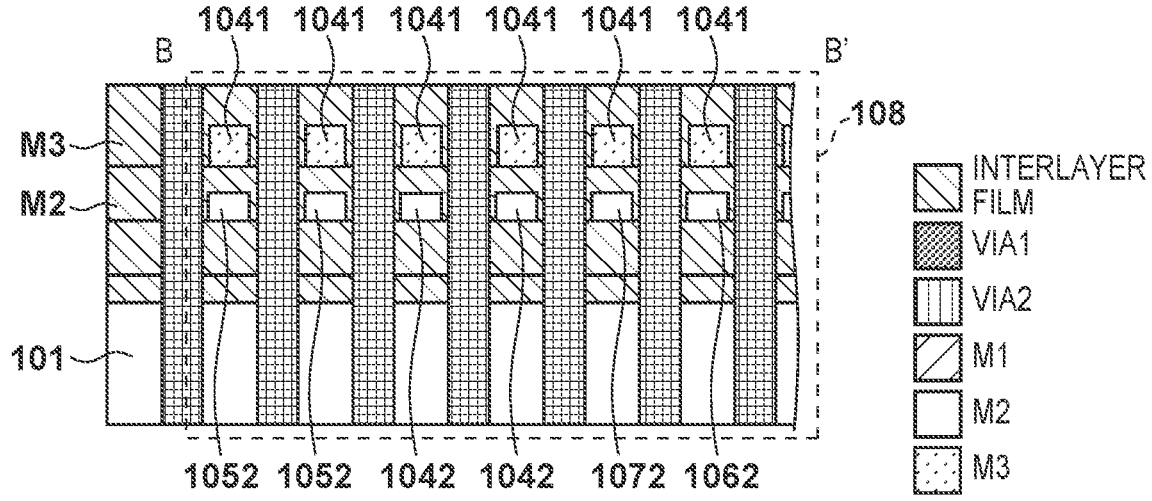

FIG. 2B is a sectional view of the liquid discharge head according to this embodiment taken along a line B-B' of FIG. 1. In the sectional view, the conductive layers are segmented by the plurality of supply ports 1031. A beam region 108, in which a plurality of "beam portions" for passing the power supply wiring are arranged, is present between the supply ports 1031 which are aligned and arranged in the first direction. The beam region 108 can include the plurality of conductive layers M1 to M3. In the second conductive layer M2, each of the second wiring groups (1052, 1042, 1062, and 1072) of the plurality of power supply/ground wirings extending in the second direction is arranged so as to be adjacent to corresponding beam portions with a supply port sandwiched in between them. On the other hand, a part of the first wiring 1041C is arranged on the third conductive layer M3 of the beam region 108.

Figure 2C:
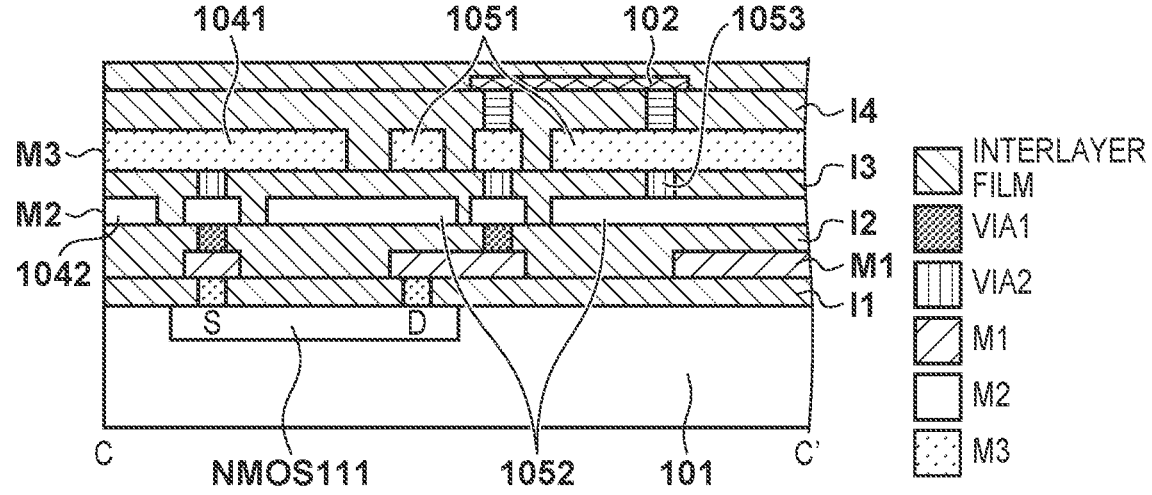

FIG. 2C is a view for explaining an example (a sectional view taken along a line C-C' of FIG. 1) of the wiring between the discharge element 102 and the driving element according to this embodiment. An NMOS transistor 111 as a driving element for turning on/off the current flowing to the discharge element 102 is formed on the substrate 101. The drain of the NMOS transistor 111 is connected to one of the terminals of the discharge element 102 via the via and the wiring of the first conductive layer M1 and second conductive layer M2. The other terminal of the discharge element 102 is connected to the first power supply wiring 1051 of the third conductive layer M3 via the via. The source of the NMOS transistor 111 is connected to the first ground wiring 1041 of the third conductive layer M3 via the via and the wiring of the first conductive layer M1 and the second conductive layer M2. This embodiment is arranged so that the current from the driving of the discharge element 102 will flow to the wiring of the third conductive layer M3. As is obvious from this example, the NMOS transistor 111 as the driving element is formed on the substrate 101 in correspondence with the discharge element 102. In addition, the control circuit (not shown) for controlling the driving element is also formed on the substrate 101 in correspondence with the driving element.

Figure 3:
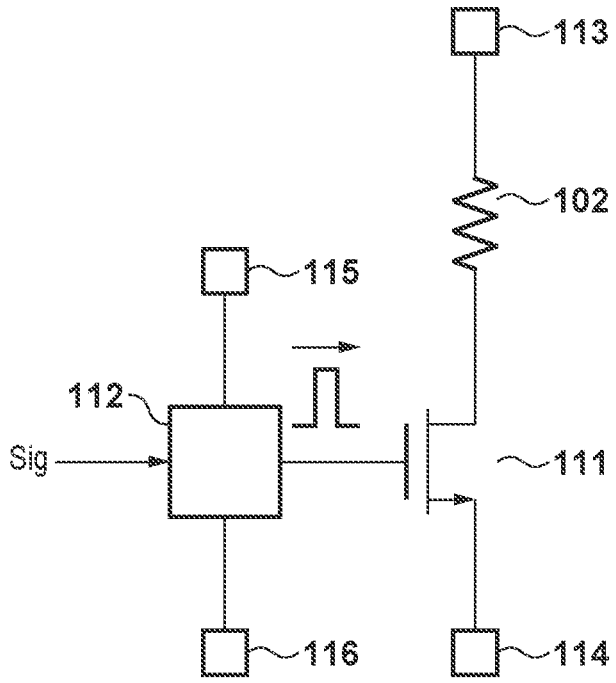
FIG. 3 is a circuit diagram of the liquid discharge head.

FIG. 3 shows one segment of the discharge element 102 and a circuit for driving the discharge element which are used in the liquid discharge head of the present disclosure. The discharge element 102 may be a heater which includes two electrical terminals. One terminal of the electrical terminals is connected to the drain terminal of the NMOS transistor 111 as the driving element. The other terminal is connected to a power supply terminal 113 for supplying a power supply voltage to the discharge element. The power supply terminal 113 is connected to the first power supply wiring 105 and can receive a current supply. The source terminal of the NMOS transistor 111 is connected to a ground terminal 114. The ground terminal 114 is connected to the first ground wiring 104. The gate terminal of the NMOS transistor 111 is connected to a control circuit 112 that outputs a signal for controlling the NMOS transistor 111. In addition, the control circuit 112 is connected to a power supply terminal 115 and a ground terminal 116 which are the power supply terminal and the ground terminal, respectively, for the control circuit. The control circuit 112 controls the ON/OFF (driving/non-driving state) state of the NMOS transistor 111 in accordance with a control signal Sig. Note that in this embodiment, the NMOS transistor 111 is connected to the ground side of the discharge element 102 and switches the current flowing to the discharge element 102. However, the NMOS transistor 111 may be arranged as a source follower by connecting the NMOS transistor 111 to the power supply side of the discharge element 102 by connecting the source terminal of the NMOS transistor to the discharge element 102.

A plurality of the segments, each including the discharge element 102, are arranged along the first direction. The power supply terminal 113 and the ground terminal 114 of the segment are connected to the first power supply wiring 105 and the first ground wiring 104, respectively, in common manner among the plurality of segments. Also, the power supply terminal 115 and the ground terminal 116 of the control circuit 112 are connected to the second power supply wiring 106 and the second ground wiring 107, respectively, in a common manner among the plurality of segments. The power supply wiring is divided between the power supply system of each control circuit and the power supply system of each discharge element and driving element here. This is because each control circuit is a circuit such as a logic circuit or the like that mainly operates based on a low voltage, and each discharge element 102 and the corresponding driving element (the NMOS transistor 111) tend to operate based on a high voltage. That is, the potential of the power supply for supplying power to the discharge element is higher than the potential of the power supply for supplying power the control circuit. Another reason for dividing the power supply and the wiring of the control circuit system is the fact that a transient high current can flow through the discharge element 102.

In this embodiment, it is arranged so that the first power supply wiring 105 and the first ground wiring 104 will be divided into two wiring layers in the extending direction, and so that one wiring among these wirings will be arranged on the same layer as the wiring of the control circuit. As a result, cost reduction becomes possible because the two conductive layers for power supply which were dedicated and assigned according to the first power supply wiring and the first ground wiring can be reduced to a single layer. Note that positions of the first ground wiring 104 and the first power supply wiring 105 within the first wiring group and the second wiring group may be switched.

In addition, in a case in which a printing apparatus has an arrangement in which each discharge element array is formed by tightly aligning discharge elements of the same color in the first direction so that the discharge element arrays which discharge different colors will be aligned in the second direction, the discharge elements belonging to the discharge element array in the first direction will need to simultaneously perform a discharge operation. On the other hand, the number of arrays to be driven simultaneously can be controlled among the discharge element arrays in the second direction. Hence, in regard to supplying the current to the discharge elements aligned and arranged in the first direction, there is a strong need for reducing variation in the resistance value of the power supply wiring in the first direction. In this embodiment, the first power supply wiring and the first ground wiring for the discharge elements will be arranged on the wiring layer in the first direction, and the second power supply wiring and the second ground wiring will be arranged on another layer. Since this arrangement will ensure the wiring width in the first direction, it will be possible to reduce the variation in the current to be supplied to the discharge elements. Although arranging the wiring of the control circuits adjacently in the same wiring layer will decrease the wiring density in the wiring layer in the second direction, a wiring structure that considers the voltage drop during the driving operation of the discharge elements 102 through which a high current will flow can be obtained.

In this embodiment, the variation in the resistance value due to the wiring of the discharge element array in the first direction may be reduced by setting a low resistance state by reducing the sheet resistance by making the film thickness of the third conductive layer M3 greater than the film thicknesses of the first conductive layer M1 and the second conductive layer M2. Reduction of the sheet resistance is not only limited to increasing the film thickness, and another method can be employed as long as a low-resistance power supply wiring can be formed in the third conductive layer M3. For example, the resistance may be reduced by using an aluminum wiring to form each of the first conductive layer M1 and the second conductive layer M2 and using a copper wiring to form the third conductive layer M3.

In addition, the first wiring group of the discharge elements was arranged on the third conductive layer M3 which is a layer higher than the second wiring group. Also, the second wiring group and the wiring of the first conductive layer M1 on the substrate are made to cooperate by vias for connecting to the control circuits formed on the substrate 101. As a result, it becomes possible to prevent the substantial wiring width of each of the second wiring group 1052 of the first power supply wiring and the second wiring group 1042 of the first ground wiring from becoming smaller than each via for the control circuit, and the wiring efficiency of the conductive layers can be increased. The variation in the resistance value can also be reduced for the first wiring group that supplies the current to the discharge elements 102.

This embodiment has an arrangement in which the second wiring group 1062 of the second power supply wiring and the second wiring group 1072 of the second ground wiring are arranged on the same conductive layer as the second wiring group 1052 of the first power supply wiring and the second wiring group 1042 of the first ground wiring. However, the embodiment is not limited to this. By arranging the control signal line on the second conductive layer M2, the control signal may be transmitted to the control circuit. Also, the driving signal can be transmitted in the second direction via the second conductive layer M2.

Second Embodiment

Figure 4:
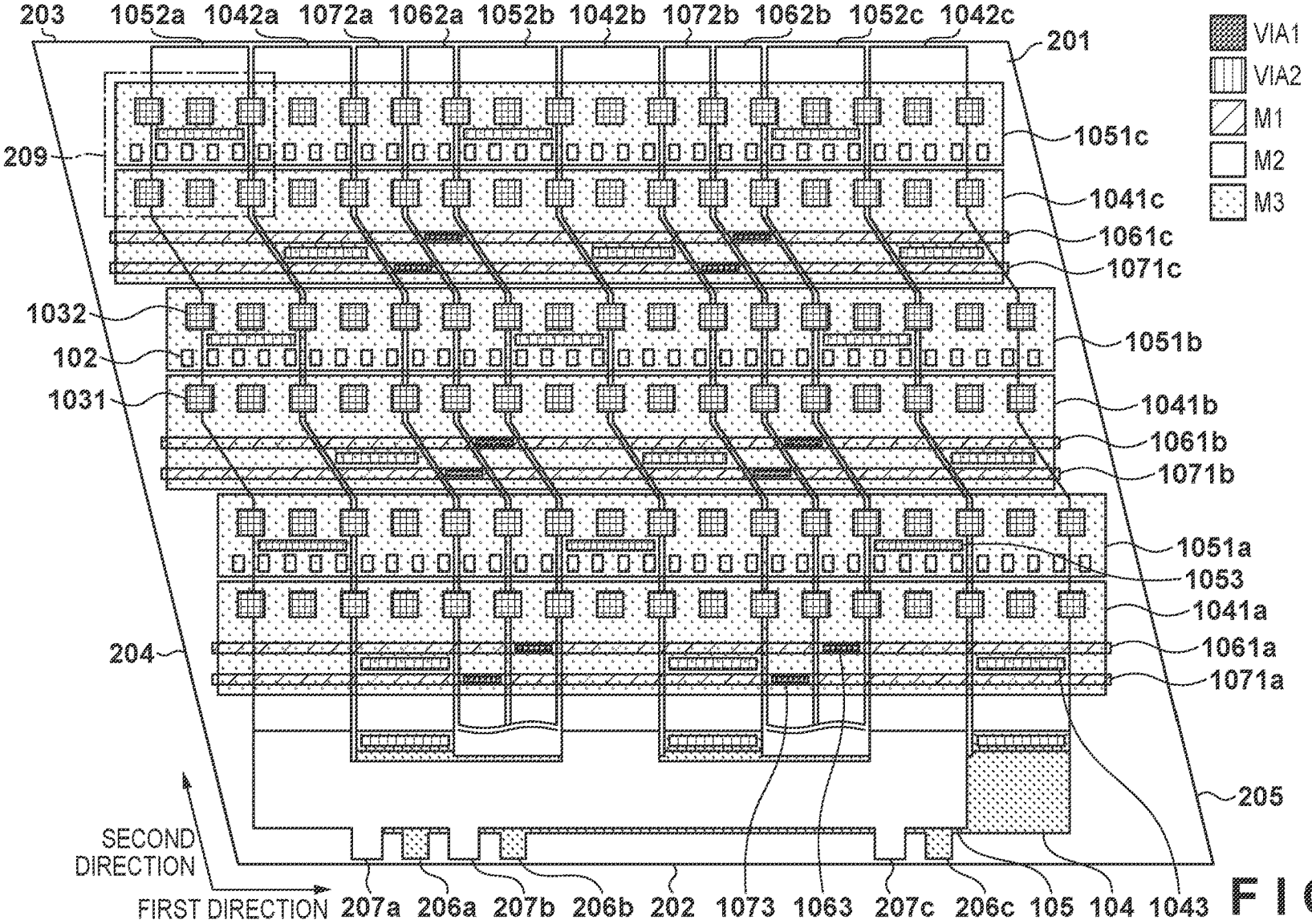
FIG. 4 is a plan view of a liquid discharge head according to the second embodiment.

FIG. 4 is a plan view of a liquid discharge head according to this embodiment. The liquid discharge head according to this embodiment uses a parallelogram-shaped chip as a substrate 201, and liquid discharge element arrays, each extending in a first direction, are arranged on the parallelogram-shaped substrate 201. This embodiment differs from the first embodiment in that the first direction is not perpendicular to a second direction.

In this embodiment, the parallelogram-shaped substrate 201 includes a first side 202 and a second side 203 which extend in the first direction and a third side 204 and a fourth side 205 which extend in the second direction intersecting with the first direction. Also, first power supply terminals 207*a* to 207*c* and first ground terminals 206*a* to 206*c* which are electrode pads for connecting a first power supply wiring 105 and a first ground wiring 104 on the substrate to the outside of the substrate are arranged along the first side 202. In this embodiment as well, in the first power supply wiring 105 and the first ground wiring 104, first wiring groups 1051 and 1041 extending in the first direction are arranged on a different conductive layer from second wiring groups 1052 and 1042 extending in the second direction. The arrangement, in which these wiring groups on different layers are connected by vias to form a lattice-like power supply wiring pattern, is similar to that of the first embodiment.

In addition, each of the discharge element arrays adjacent to each other in the first direction is arranged in a position shifted in the first direction so as to be positioned along the third side 204 and the fourth side 205. The second wiring group for the discharge elements and the control circuits may include a portion extending in a direction perpendicular to the first direction and a portion extending along the third side and the fourth side between the discharge element arrays. The second wiring group overall is arranged so as to extend toward the second direction.

The embodiment will be described by using the first ground wiring 104 as an example hereinafter. In contrast to other segments, each segment closer to the third side 204 than the first ground terminal 206*a* is positioned farther from the first ground terminals 206*b* and 206*c*, which are ground terminals other than the closest first ground terminal 206*a*. Hence, in each segment closer to the third side 204 than the first ground terminal 206*a*, the wiring resistance to the first ground terminals 206*b* and 206*c* tends to be higher than the wiring resistance to the first ground terminal 206*a*.

The first ground wiring 104 is a parallelogram-shaped lattice-like wiring having a shape corresponding to the shape of the substrate. The angle formed by the second side 203 and the third side 204 and the angle formed by the first side 202 and the fourth side 205 are acute angles. The angle formed by the first side 202 and the third side 204 and the angle formed by the second side 203 and the fourth side 205 are obtuse angles. Hence, an acute angle and an obtuse angle form the respective angles of the corners at both ends of the first side 202. The first side 202, on which the first ground terminals 206*a* to 206*c* are arranged, is arranged on the opposite side of the second side 203. Also, the shape of the region near the intersection point of the second side 203 and the third side 204 differs from the shape of the region near the intersection point of the second side 203 and the fourth side 205. The current path is physically restricted since the power supply wiring is interrupted at the end of the substrate 201. The physical restriction of the current path arrangement will increase as the angle (acute angle) formed by the two sides decreases.

For these reasons, the locational dependency of the amount of voltage drop due to resistance in the current paths from the first ground terminals 206*a* to 206*c* will be larger in a case in which the substrate 201 is a parallelogram-shaped chip than in a case in which each corner of the chip is a right angle. Hence, the voltage drop tends to be largest at a region 209 near the point where the second side and the third side intersect at an acute angle. However, by adopting an arrangement that reduces the wiring resistance in the first direction in a similar manner to that of the first embodiment, the locational dependency of the amount of voltage drop due to the resistance generated when a current flows in the parallelogram-shaped chip can be reduced in this embodiment.

In addition, in this embodiment, the first ground terminals arranged along the first side will be arranged so that the number of the first ground terminals arranged closer to the third side 204 than the fourth side 205 will be larger than the number of the first ground terminals arranged closer to the fourth side 205 than the third side 204. As a result, the wiring resistance generated in the region 209 can be reduced because the first ground terminal 206*a* can be arranged closer to the region 209 on the substrate 201.

The minimum value of wiring resistance of the first ground wiring 104 is obtained near each first ground terminal 206 and depends on the arrangement location of each first ground terminal 206. Even if the position of the segment where the minimum resistance value is obtained changes, the minimum value will not change. Hence, the application of the present disclosure can reduce the maximum resistance value as well as reduce the difference between the minimum resistance value and the maximum resistance value of the current path in the first ground wiring 104 of the discharge elements in all of the segments of the parallelogram-shaped substrate including the lattice-like wiring.

Variation in discharge characteristics is a problem for the liquid discharge head since the voltage drop due to the wiring resistance can increase when many discharge elements 102 are turned on and driven simultaneously. According to the arrangement of this embodiment, since the maximum resistance value can be reduced, the variation will be reduced even if many discharge elements 102 are turned on and driven simultaneously. Since this will allow many discharge elements to be arranged, the printing speed can be increased.

In addition, the power to be supplied to each discharge element is determined in the liquid discharge head so that a sufficient amount of heat can be obtained even in a segment which includes a driving element and a discharge element with a high wiring resistance. Hence, if there is a difference between the minimum value and the maximum value of the wiring resistance, extra power will be consumed because the amount of voltage drop will increase in each discharge element 102 of a segment with a low wiring resistance. This may shorten the life of each segment with a low wiring resistance. Since reducing the difference between the minimum value and the maximum value of the wiring resistance in the manner of this embodiment will adjust the current so that extra power consumed in each discharge element of a segment with a low wiring resistance will be reduced, the life of the discharge element can be prolonged.

Note that an arrangement that can reduce variation by reducing the wiring resistance has been described here by using the example of the first ground wiring 104 and the first ground terminals 206*a* to 206*c*. However, as a matter of course, for the first power supply wiring 105 and the first power supply terminals 207*a* to 207*c*, the advantage due to the positions of the power supply terminals can also be established in a manner similar to those of the ground power supply and the ground terminals. Note that each first ground terminal 206 and each first power supply terminal 207 may be arranged at the end of the third conductive layer M3. Alternatively, each first ground terminal 206 may be arranged by setting the entire end along the first side of the second conductive layer M2 as the conductive portion for the ground terminals, and each first power supply terminal 207 may be arranged by setting the entire end along the first side of the third conductive layer M3 as the conductive portion for the first power supply terminals.

Third Embodiment

Figure 5:
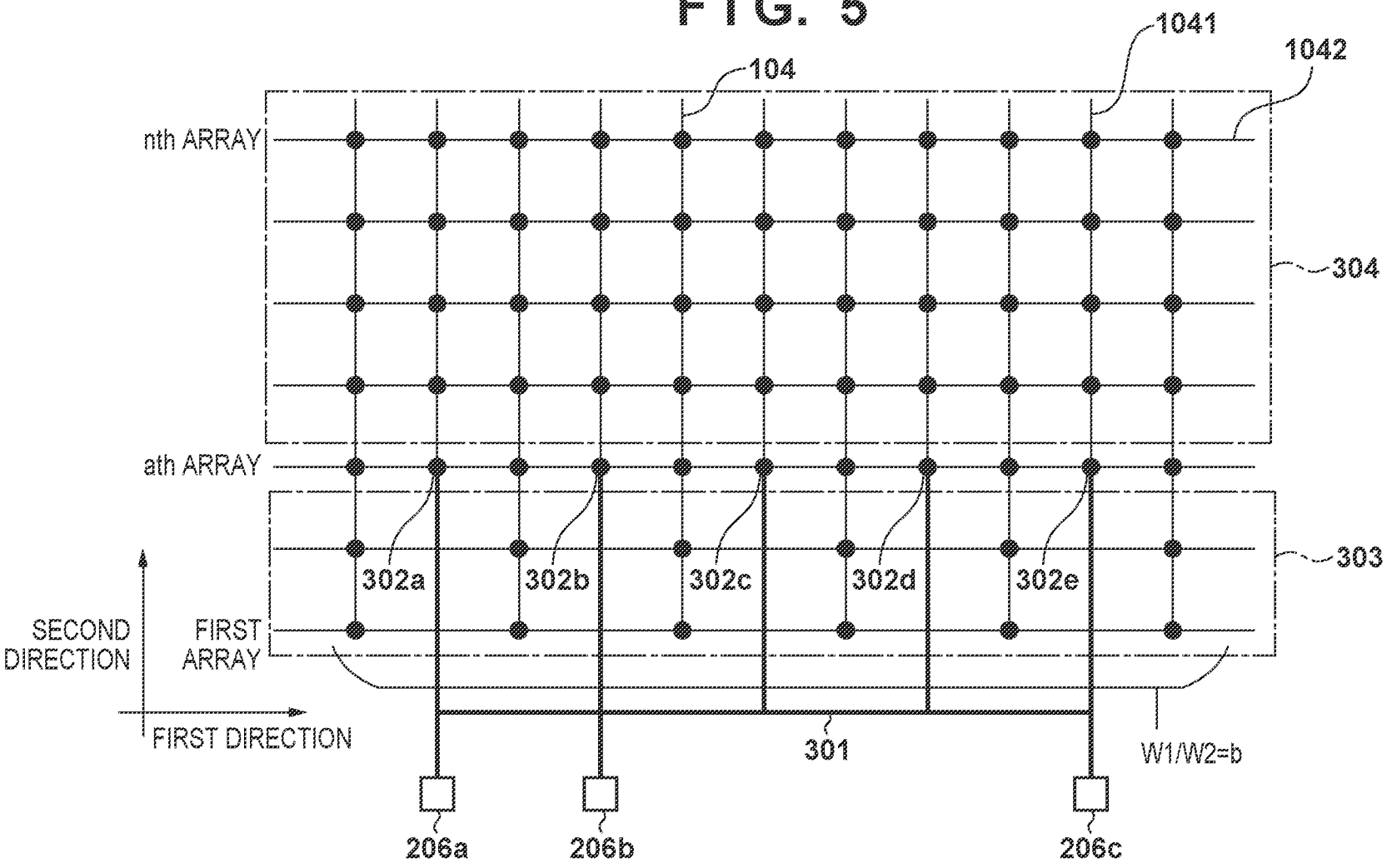
FIG. 5 is a wiring diagram of a ground wiring of a liquid discharge head according to the third embodiment.

An example in which reduction of a voltage drop in a wiring is further implemented when n discharge element arrays are arranged in a second direction will be described next by using a first ground wiring 104 as an example. In this embodiment, the first ground wiring 104, that supplies power to the discharge elements of a predetermined array of the n discharge element arrays that have been aligned and arranged, and the first ground terminals 206*a* to 206*c* are connected by leading wirings. By doing so, the variation in the voltage drop in the wiring to the discharge element is suppressed. A description will be given hereinafter with reference to FIGS. 5 and 6. FIG. 5 is a wiring diagram of a first wiring group and a second wiring group of the first ground wiring 104 of a liquid discharge head according to this embodiment. Discharge element arrays, each formed by arranging discharge elements in a first direction, are arranged on a substrate, and n arrays of discharge elements are arranged in the second direction. In a manner similar to the other embodiments, in the first ground wiring 104 to the discharge elements, the first wiring group is arranged on a third conductive layer M3 and the second wiring group is arranged on a second conductive layer M2. The first wiring group is arranged extending in the first direction, and the second wiring group is arranged extending in the second direction perpendicular to the first direction.

FIG. 5 shows a simplified state in which first ground wirings 1041 of the first wiring group and first ground wirings 1042 of the second wiring group are shown to be in a lattice-like state in a planar view of the substrate. The locations connected by vias between the first wiring group and the second wiring group correspond to the intersection points (black dots) of the lattice. In addition, first ground terminals 206*a* to 206*c* are arranged along the side at the end of the substrate. The first ground terminals 206*a* to 206*c* are connected to the first ground wiring 104 by leading wirings 301. The leading wirings 301 are connected to the first ground wiring 104 by connection points 302*a* to 302*e*.

In this embodiment, all of the connection points 302*a* to 302*e* are arranged on the same array (ath array) of the discharge element arrays. The leading wirings 301 are not connected (that is, a≠1) to the discharge element array which is closest to the first ground terminals 206*a* to 206*c*. Note that a description will be given by setting, as the first array, the discharge element array closest to the side on which the first ground terminals 206*a* to 206*c* are arranged, and setting the farthest discharge element array as the nth array. Assume that the leading wirings 301 are led out from positions (locations connected by vias in this example) where the intersection points between the first wiring group and the second wiring group of the first ground wiring 104 of the discharge elements of the ath array are present. In addition, the leading wirings 301 are arranged by using some of the first ground wirings 1042 of the second wiring group arranged in the second direction.

In the following description, a region where the first ground wiring 104 belonging to the discharge element array closer to the first ground terminals 206*a* to 206*c* than the ath array will be referred to as a first lattice-like wiring region 303. A region where the first ground wiring belonging to the discharge element array on a side far from the first ground terminals 206*a* and 206*c* than the ath array will be referred to as a second lattice-like wiring region 304. Since some of the first ground wirings in the second direction are used as the leading wirings 301, the number of wirings extending in the second direction differs between the first lattice-like wiring region 303 and the second lattice-like wiring region 304. The first lattice-like wiring region 303 has fewer wirings in the second wiring group than the second lattice-like wiring region 304 for the amount of wirings used for the leading wirings 301.

Figure 6:
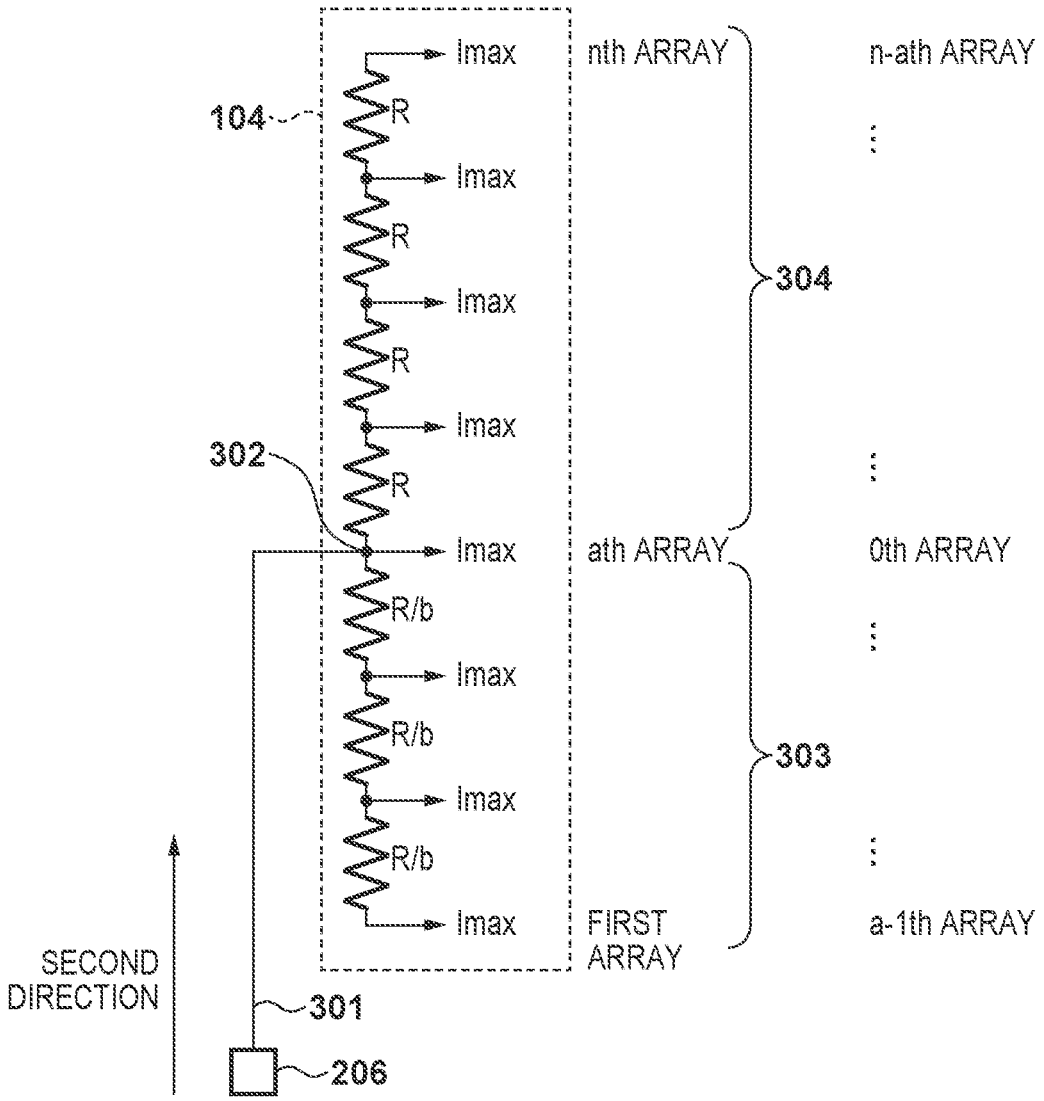
FIG. 6 is an equivalent circuit diagram of a power supply wiring according to the third embodiment.

FIG. 6 shows an equivalent circuit of a power supply wiring according to this embodiment. One end of each leading wiring 301 is connected to the corresponding first ground terminal 206, and the other end is connected to the corresponding connection point 302 of the ath (a≠1) discharge element array. The first ground wiring 104 is divided into the two regions of the first lattice-like wiring region 303 and the second lattice-like wiring region 304 from the connection point 302 as the boundary. (a−1) discharge element arrays from the first array to the (a−1)th array are arranged in the first lattice-like wiring region 303. In addition, (n−a) discharge element arrays from the (a+1)th array to the nth array are arranged in the second lattice-like wiring region 304. Also, each discharge element array has a wiring resistance in the second direction. In this case, each of (a−1) and (n−a) is a number less than n.

In the wiring in the second direction of the first ground wiring 104 connected to each discharge element array, when each wiring resistance R is connected in series, a current consumed by a discharge element which is arranged away from the first ground terminal 206 flows through the ground wiring 104 close to the first ground terminal 206. The amount of voltage drop depends on the number of discharge element arrays in the second direction. The maximum amount of voltage drop in the lattice-like wiring region is equal to the total amount of voltage drops of all of the arrays from the connection point 302 to the end. If each leading wiring is connected to the corresponding connection point 302 and the first ground wiring 104 is divided as shown in FIG. 6, it is possible to decrease the number of discharge element arrays that will be passed from the first ground terminal 206 until the end of the wiring. Hence, compared to a case in which the lattice-like wiring is not divided by the connection point 302, it becomes possible to suppress the maximum amount of voltage drop from the first ground terminal 206. On the other hand, each location where the amount of voltage drop is minimized will be set as the connection point 302 regardless of the position of the connection point in the first direction. By arranging each connection point 302 (that is, in the ath array where 1<a<n) so as to divide the power supply into a plurality of systems in the liquid discharge head in which n discharge element arrays are arranged in the second direction, the voltage drop amount difference between the discharge element arrays can be smaller than in a case in which the first ground terminals are arranged in the first array.

Note that the maximum amount of voltage drop can be reduced the most in a case in which the amount of voltage drop in the first lattice-like wiring region 303 and the amount of voltage drop in the second lattice-like wiring region 304 are equal. The condition for equating the amount of voltage drop of the first lattice-like wiring region 303 with the amount of voltage drop of the second lattice-like wiring region 304 will be further described with reference to FIG. 6. FIG. 6 assumes that a current Imax is consumed for each discharge element array. Note that the current Imax corresponds to the amount of current consumed when all of the drivable discharge elements are simultaneously driven in a predetermined discharge element array. A total wiring width W of the second wiring groups 104 of each lattice-like wiring region (303, 304) can be defined as follows by assuming it to be a total of an average wiring width Wp of the pth wiring of the r wirings of the second wiring groups of the lattice-like wiring regions. Where, r refers to the number of wirings between the connection point 302 and the end, and p refers to the pth wiring of the r wirings between adjacent discharge elements.

$$W=\Sigma_{p=1}{}^{r}Wp \tag{1}$$

The wiring extending in the second direction may also be arranged by using a plurality of types of wirings with different wiring widths. In this case, let W1 be the total wiring width of the first lattice-like wiring region 303 and W2 be the total wiring width of the second lattice-like wiring region 304. Furthermore, b=W1/W2 can be expressed by defining the ratio of the total wiring width W1 to the total wiring width W2 as a wiring width ratio b. In this embodiment, the number of wirings used as the second wiring group decreases in the first lattice-like wiring region 303 because the leading wirings 301 are arranged. Hence, since the total wiring width W1 will be smaller than the total wiring width W2 if there is no large difference in the wiring widths of the second wiring groups, the wiring width ratio b<1 will be set.

An amount V2 of the voltage drop from each connection point 302 to the end of the wiring can be expressed as follows as a total of the voltage drop amounts of (n−a) arrays.

$$V2=\sum_{q=1}^{n-a}(q\times R\times I\max)=\frac{(n-a+1)(n-1)}{2}\times R\times I\max \tag{2}$$

where R is the value of the wiring resistance between adjacent discharge elements in a discharge element array in the second direction in the second lattice-like wiring region 304.

On the other hand, since the wiring width ratio is b, the resistance value of the wiring per discharge element array in the first lattice-like wiring region 303 becomes 1/b times (>1) of the resistance value R. In a calculation similar to that of the second lattice-like wiring region 304, an amount V1 of the voltage drop from the connection point 302 to the end in the first lattice-like wiring region 303 which includes (a−1) discharge element arrays can be expressed as follows.

$$V1=\sum_{q=1}^{a-1}(q\times R\times I\max)=\frac{a(a-1)}{2}\times\frac{R}{b}\times I\max \tag{3}$$

The amount of voltage drop in the second lattice-like wiring region 304 and the amount of voltage drop in the first lattice-like wiring region 303 are equated (V1=V2). In this case, the following relationship is established between the number n of discharge element arrays, the ath array connection point of the leading wirings, and the wiring width ratio b of the first lattice-like wiring region 303.

$$\frac{a(a-1)}{2b}\times R\times I\max=\frac{(n-a+1)(n-a)}{2}\times R\times I\max$$

The following equation is obtained by solving this relationship with respect to a.

$$a=\frac{1}{2}+\frac{-2n+\sqrt{\frac{4}{b}n^2+\left(1-\frac{1}{b}\right)^2}}{2\left(\frac{1}{b}-1\right)} \tag{4}$$

In this embodiment, the optimal connection point is a=3.85 in a case in which the number n of discharge element arrays=10 and the wiring width ratio b=0.25. In this case, each leading wiring can be connected to the connection point in the fourth array which has an integer closest to a. By satisfying the above-described relationship, the difference between the amount of voltage drop generated in the first lattice-like wiring region 303 and the amount of voltage drop generated in the second lattice-like wiring region 304 can be made substantially zero so that the voltage drop amount difference generated between the lattice-like wiring regions can be minimized.

In addition, by designing so that the value of the wiring width ratio b will be decreased by adjusting the total wiring width of the power supply wiring of the first lattice-like wiring region 303 and the second lattice-like wiring region 304, it will be possible to decrease the value of the optimal leading wiring connection point a. That is, the length of each leading wiring can be reduced.

As a method of decreasing the value of the wiring width ratio b, it is preferable to increase the number of wirings or set a large wiring width in each wiring extending in the second direction in the second lattice-like wiring region 304. Alternatively, the number of the leading wirings 301 can be increased and the number of the second wiring groups in the first lattice-like wiring region may be decreased. The amount of voltage drop in the first ground wiring 104 can be reduced by arranging the connection point 302 close to the side of the first array while reducing the voltage drop in the second direction in the second lattice-like wiring region, and reducing the difference in the amount of voltage drop in the lattice-like wiring regions while decreasing the length of the leading wiring. The above has been described by the example in which the leading wirings 301 are connected to the first ground wiring 104. However, a similar advantage can also be obtained in a case in which leading wirings are connected to a first power supply wiring 105. The number of leading wirings is not limited to that of this embodiment.

As an example, an example in which leading wirings are connected to the first ground wiring 104 at the ath array and the leading wirings 301 are connected to the first power supply wiring 105 at the first array as in the first embodiment of the present disclosure will be described. In the first power supply wiring 105, the discharge elements will not be influenced much by a voltage drop even as the total wiring width W is decreased as the nth array becomes closer. On the other hand, the voltage drop amount difference in the first ground wiring will influence the ON resistance of the driving element because the source side of a NMOS transistor 111 as the driving element will float from the ground. Hence, the ON resistance variation for each discharge element array can be suppressed by reducing the voltage drop amount difference by arranging the leading wirings for the first ground wiring.

Fourth Embodiment

Figure 7:
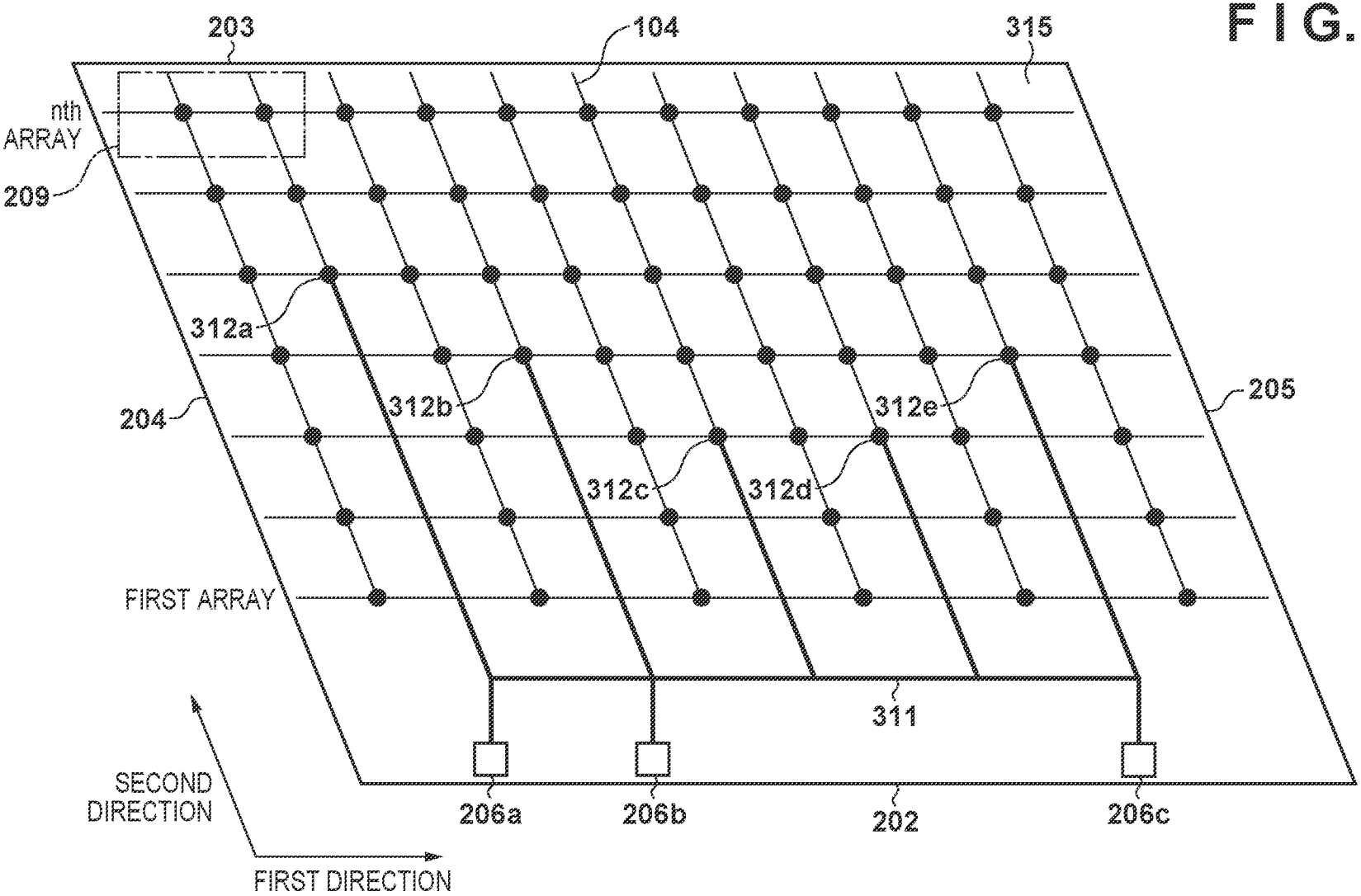
FIG. 7 is a wiring diagram of a ground wiring of a liquid discharge head according to the fourth embodiment.

FIG. 7 is a wiring diagram of a first ground wiring 104 of a semiconductor apparatus for a liquid discharge head according to this embodiment. This embodiment differs from the third embodiment in that the shape of a substrate 315 is a parallelogram and connection points 312*a*, 312*b*, and 312*e* of some leading wirings are connected to the wirings of discharge element arrays which are farther from the first ground terminals 206 than connection points 312*c* and 312*d*.

In a parallelogram-shaped chip, the amount of voltage drop in a region 209 near an intersection point of a second side 203 and a third side 204 will reach a maximum value due to the restriction of the power supply path. In a similar manner, the amount of voltage drop due to the restriction of a current path increases in a region near an intersection point of the second side 203 and a fourth side 205. Hence, in the vicinity of the third side 204 and the fourth side 205, the connection points 302 of some of the substrate leading wirings will be arranged at locations away from the power supply terminals. By arranging the connection points of the leading wirings close to the regions where the voltage drop amount increases, the maximum value of a voltage drop that occurs in the region 209 can be reduced.

The effect of connecting the leading wirings to different arrays can be considered as follows. Assume that there are r leading wirings which have different connection points 312 from each other, and each of pth leading wirings is connected to a Qpth array at a wiring width Wp. At this time, the connection points of the leading wirings can be assumed to be equivalent to that in a state in which the leading wirings are connected to an xth array calculated as follows as a weighted average by the average wiring width Wp.

$$x = \sum_{p=1}^{r} \frac{W_p}{\sum_{p=1}^{r} Wp} \times Qp \tag{5}$$

The xth array calculated by equation (5) is set to be an ath array calculated by equation (4). Furthermore, the voltage drop amount difference generated in the lattice-like wiring regions in this embodiment can be reduced by adjusting Qp arrays on the side closer to the third side 204 and on the side closer to the fourth side 205 to reduce the resistance value with respect to a region with a high wiring resistance from an electrode pad which is connected to an external portion. Although a parallelogram-shaped chip was a target of this embodiment, the embodiment is not limited to this. The voltage drop amount due to the restriction of the current path can also be expected to increase in the edge portion compared to the center in the substrate end of a rectangular chip. Thus, it is effective that the connection point of each leading wiring from the ground terminals are located farther from the ground terminals at positions close to the third side and the fourth side adjacent to the first side on which the ground terminals are provided. An example in which leading wirings 301 are connected to the first ground wiring 104 has been described here. However, a similar effect can also be obtained in a case in which the leading wirings 301 are connected to a first power supply wiring 105. The number of leading wirings 301 is not limited to that of this embodiment.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefits of priority from Japanese Patent Application No. 2020-005410, filed Jan. 16, 2020, which is hereby incorporated by reference herein in its entirety.

What is claimed is:

1. A liquid discharge head comprising:

a plurality of discharge elements each arranged in a first direction;

a plurality of driving elements connected to the plurality of discharge elements and each configured to drive a corresponding one of the plurality of discharge elements;

a plurality of control circuits each configured to control a corresponding one of the plurality of driving elements;

a first ground wiring and a first power supply wiring configured to supply power to the plurality of discharge elements and the plurality of driving elements;

a second ground wiring and a second power supply wiring configured to supply power to the plurality of control circuits; and a plurality of supply ports arranged along the first direction and configured to supply a liquid to the plurality of discharge elements, wherein the first ground wiring and the first power supply wiring include, in a first conductive layer of a plurality of conductive layers which have been stacked, a first wiring group extending in the first direction, and include, in a second conductive layer different from the first conductive layer of the plurality of conductive layers, a second wiring group extending in a second direction which intersects with the first direction, and the second power supply wiring is arranged in one of the first conductive layer and the second conductive layer.

2. The liquid discharge head according to claim 1, wherein the second ground wiring and the second power supply wiring are arranged in the second conductive layer.

3. The liquid discharge head according to claim 1, wherein the first power supply wiring of the first wiring group and the first power supply wiring of the second wiring group are connected by a via, and the first ground wiring of the first wiring group and the first ground wiring of the second wiring group are connected by a via.

4. The liquid discharge head according to claim 1, wherein a first potential is supplied to the first power supply wiring, a second potential is supplied to the second power supply wiring, and the first potential is higher than the second potential.

5. The liquid discharge head according to claim 1, wherein a sheet resistance of the first conductive layer is lower than a sheet resistance of the second conductive layer.

6. The liquid discharge head according to claim 1, wherein a thickness of the first conductive layer is larger than a thickness of the second conductive layer.

7. The liquid discharge head according to claim 1, wherein the first conductive layer is arranged at a position closer to the side on which the plurality of discharge elements are arranged than the second conductive layer.

8. The liquid discharge head according to claim 1, wherein discharge element arrays each including the plurality of discharge elements are aligned and arranged in the second direction.

9. The liquid discharge head according to claim 1, further comprising a substrate, on which the plurality of conductive layers are formed, which includes a first side and a second side which extend in the first direction and a third side and a fourth side which extend in the second direction; and a plurality of electrode pads, which are connected to the first ground wiring and the first power supply wiring, are arranged along the first side, wherein the first side and the third side are adjacent to each other, and the first side and the fourth side are adjacent to each other.

10. The liquid discharge head according to claim 9, wherein an angle formed by the first side and the third side is an obtuse angle, and an angle formed by the first side and the fourth side is an acute angle.

11. The liquid discharge head according to claim 10, wherein a number of electrode pads arranged closer to the third side than the center of the first side, is greater than a number of electrode pads arranged closer to the fourth side than the center of the first side.

12. The liquid discharge head according to claim 9, wherein the plurality of electrode pads are connected to the first ground wiring and the first power supply wiring by a plurality of leading wirings, wherein a plurality of discharge element arrays each including the plurality of discharge elements are arranged in the second direction, and wherein the plurality of leading wirings are connected to at least one of the first ground wiring and the first power supply wiring of the first wiring group that supplies power to the discharge element arrays, excluding a first discharge element array which is closest to the plurality of electrode pads and an nth discharge element array which is farthest from the plurality of the electrode pads.

13. The liquid discharge head according to claim 12, wherein the plurality of leading wirings are connected to at least one of the first ground wiring and the first power supply wiring of the first wiring group that supplies power to the discharge element array which is away from the plurality of electrode pads by a predetermined number of arrays, and are connected to the electrode pads by extending in the second direction from the connected locations, and when a region including the first to a (predetermined number of arrays−1)th discharge element arrays, as arranged from the electrode pads, is set as a first region, and a region including a (predetermined number of arrays+1)th to nth discharge element arrays, is set as a second region, the predetermined number of arrays is an array corresponding to an integer closest to a value a obtained by $$A = \frac{1}{2} + \frac{-2n + \sqrt{\frac{4}{b}n^2 + \left(1 - \frac{1}{b}\right)^2}}{2\left(\frac{1}{b} - 1\right)}, \quad b = \frac{W1}{W2}$$

where W1 is a first wiring width which is a total of wiring widths of the second wiring group of the first region, W2 is a second wiring width which is a total of wiring widths of the second wiring group of the second region, and b is a ratio of the first wiring width W1 and the second wiring width W2.

14. The liquid discharge head according to claim 12, wherein the plurality of leading wirings are connected to at least one of the first ground wirings and the first power supply wiring of the first wiring group that supplies power to at least two different discharge element arrays.

15. The liquid discharge head according to claim 14, wherein a first position, of a predetermined region that includes the third side or the fourth side, is farther from the electrode pads than a second position, of a predetermined region that includes a center portion of the first side.

16. The liquid discharge head according to claim 1, wherein the first wiring group in the first conductive layer and the second wiring group in the second conductive layer intersect with each other in a plan view.

17. The liquid discharge head according to claim 16, wherein the first power supply wiring of the first wiring group and the first power supply wiring of the second wiring group are connected by a via at a position where the first power supply wiring of the first wiring group intersects with the first power supply wiring of the second wiring group in the plan view, and the first ground wiring of the first wiring group and the first ground wiring of the second wiring group are connected by a via at a position where the first ground wiring of the first wiring group intersects with the first ground wiring of the second wiring group in the plan view.

* * * * *